US008245323B2

(12) United States Patent
Shao

(10) Patent No.: US 8,245,323 B2
(45) Date of Patent: Aug. 21, 2012

(54) HEAD-WORN LIQUID SHIELD

(75) Inventor: Hui Shao, Portland, OR (US)

(73) Assignee: Hui Shao, Portland, OR (US)

( * ) Notice: Subject to any disclaimer, the term of this patent is extended or adjusted under 35 U.S.C. 154(b) by 777 days.

(21) Appl. No.: 12/343,113

(22) Filed: Dec. 23, 2008

(65) Prior Publication Data

US 2010/0154100 A1 Jun. 24, 2010

(51) Int. Cl.
*A45D 44/12* (2006.01)

(52) U.S. Cl. ..... 2/174; 2/46; 2/50; 2/171; 2/67; 2/202; 4/521; 132/212

(58) Field of Classification Search ..... 2/174, 171, 2/46, 50, 67, 202, DIG. 10; 4/521; 132/212
See application file for complete search history.

(56) References Cited

U.S. PATENT DOCUMENTS 1,524,863 A * 2/1925 Houston ..... 4/520
2,032,898 A * 3/1936 Wilson ..... 4/521
3,996,946 A * 12/1976 Craig ..... 132/212
5,099,865 A * 3/1992 Flannery et al. ..... 132/212
5,146,629 A 9/1992 Barnes
5,551,088 A * 9/1996 Stepp ..... 2/174
5,940,885 A * 8/1999 Matthews ..... 2/174
6,519,777 B1 * 2/2003 Speelman ..... 2/174
6,584,984 B2 * 7/2003 Kelly ..... 132/212
7,310,827 B2 12/2007 Ciesinski et al.
2007/0094770 A1 * 5/2007 Ciesinski et al. ..... 2/174

FOREIGN PATENT DOCUMENTS

CN 2461362Y B2 11/2001

* cited by examiner

*Primary Examiner* — Alissa Tompkins

(74) *Attorney, Agent, or Firm* — Lee & Hayes, PLLC

(57) ABSTRACT

A head-worn liquid shield has a substantially half-circled brim, a tautening edge portion, and a sealing tube that provides an effective sealing means for protecting a user's face, nose, ears and eyes from water, soap, shampoo and other hairdressing materials. The sealing tube is compressible to result in a diameter size automatically adjusted according to the pressure exerted on the sealing tube by the user's head.

26 Claims, 10 Drawing Sheets

HEAD-WORN LIQUID SHIELD

TECHNICAL FIELD

This disclosure relates to a head-worn liquid shield preventing water, shampoo and other hairdressing materials from entering into a user's eyes, ears, nose and mouth while washing or rinsing the user's hair in a bathtub or other vessels. The disclosure is especially useful when the user is a baby or child.

BACKGROUND

The water, soap, and shampoo often come into a user's eyes, ears, nose and mouth while washing or rinsing the hairs. Such unpleasant experiences may even develop a fear of hair washing especially when the user is a baby or child.

For example, a 0-6 month old baby cannot sit uprightly in the bathtub so that the baby has to lean backward the backrest of the bathtub to have the hair washed. Since the eyes, nose and mouth of the baby are lower than the front portion of the head, there is a good chance that shampoo and water would get into the baby's eyes, nose and mouth.

After 6 months, the baby can sit uprightly, but the situation does not turn better. As the baby grows up, he/she becomes more playful while bathing. As a result, it is more difficult to keep the child's head in a proper position to get her/his hair washed and prevent the water, soap, and shampoo from entering into the baby's eyes, ears, and nose. Therefore, the parents have to hold the baby to a position that the baby's head is lower than his body. Holding a baby in such a position in a limit space and slippery bathtub is extremely inconvenient for the parents and dangerous for the baby.

There are many liquid shields on the market. These liquid shields, however, are often complicated and only suitable to use in the barber shops. Furthermore, these liquid shields often fail to provide a satisfactory means to closely secure the guards to the skin of the user to prevent the water or shampoo from flowing through the user's face.

SUMMARY

The present disclosure provides a head-worn liquid shield that prevents water and shampoo from entering into the user's eyes, ears, nose and mouth regardless whether the child's upper body is in an upright position. It is especially useful when the user is a baby or child and the parents have to wash the user's hairs in a bathtub or other vessels.

The liquid shield has a half-circled brim, a tautening edge portion encircling the user's hairline from ear to ear via the forehead of the user, and a sealing tube attached to the tautening edge portion. The sealing tube is compressible and has a diameter size automatically adjusted according to the pressure applied on the sealing tube by the user's head. The sealing tube provides effective sealing for protecting the user's face, nose, ears and eyes from water, soap, shampoo and other hairdressing materials.

In one embodiment, the sealing tube is hollow filled with air. In other embodiments, the sealing tube is hollow and partially filled with one or more compressible materials. In some other embodiments, the sealing tube is hollow and completely filled with one or more compressible materials.

The compressible sealing tube effectively distributes the pressure along the user's hairline from the forehead to ears. It automatically increases the pressure in areas which otherwise would have undesirably low pressure, such as the forehead area, and thus improves the sealing. This design is simple to manufacture and thus provides an inexpensive liquid shield for most families.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE FIGURES

The detailed description is described with reference to the accompanying figures. In the figures, the same numbers are used throughout the drawings to reference like features and components.

FIG. 11-1 is a top plan view of the liquid shield worn by a user where there is a small gap between the user's skin and the sealing tube.

FIG. 11-2 is a top plan view of the liquid shield worn by a user where the small gap between the user's skin and the sealing tube is eliminated by pressing the sealing tube.

FIG. 12-1 is a top plan view of the liquid shield worn by a user where there is a wide gap between the user's skin and the sealing tube.

FIG. 12-2 is a top plan view of the liquid shield worn by a user where the wide gap between the user's skin and the sealing tube is eliminated by using a pump.

FIG. 14-1 is an enlarged view of one end of the sealing tube and illustrates the inflation means where the inflation means is a pump and the pump is pumping air into the sealing tube.

FIG. 14-2 is an enlarged view of one end of the sealing tube and illustrates the inflation means where the inflation means is a pump and the pump finishes pumping air into the sealing tube.

FIG. 14-3 is an enlarged view of one end of the sealing tube and illustrates the inflation means where the inflation means is a pump and the pump is removed from the liquid shield.

FIG. 15-1 is an enlarged view of one end of the sealing tube and illustrates another inflation means where the inflation means is a pipe and a cap of the pipe is close.

FIG. 15-2 is an enlarged view of one end of the sealing tube and 81illustrates another inflation means where the inflation means is a pipe and a cap of the pipe is open.

DETAILED DESCRIPTION

The following discussion is directed to a head-worn liquid shield for protecting a user's face, nose, ears and eyes from water, soap, shampoo and other hairdressing materials.

Figure 1:
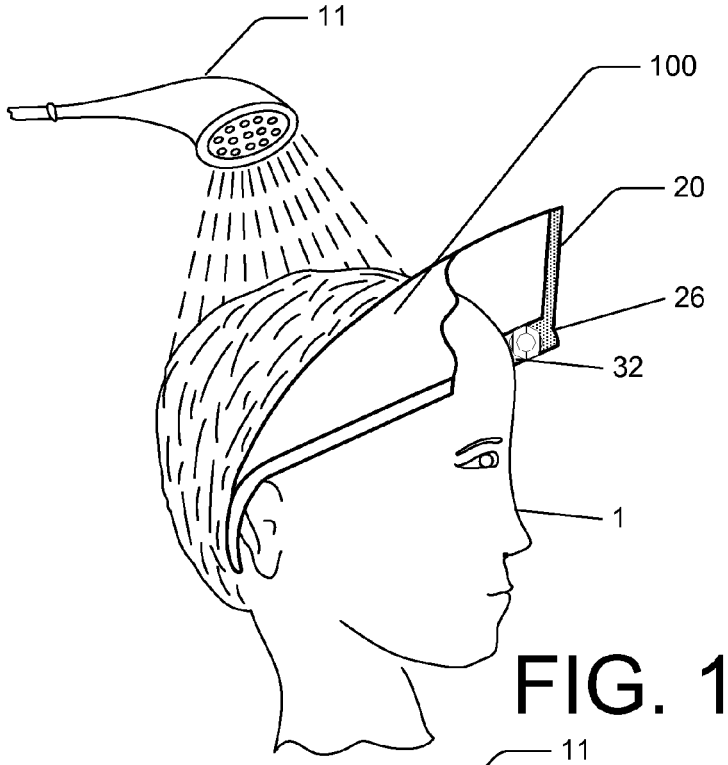
FIG. 1 is a perspective view of an exemplary head-worn liquid shield worn by a user.

FIG. 1 illustrates an exemplary perspective view of the head-worn liquid shield 100. For example, the user 1 wears the liquid shield 100 while hair washing under the shower head 11. The liquid shield 100 includes a tautening edge portion 26, a brim 20, and a sealing tube 32 attached to the tautening edge portion 26. In FIG. 1, the wave line denoting a broken edge on the liquid shield indicates a cross-section view of the shaded portion of the liquid shield, including the tautening edge portion 26 and the sealing tube 32.

Figure 2:
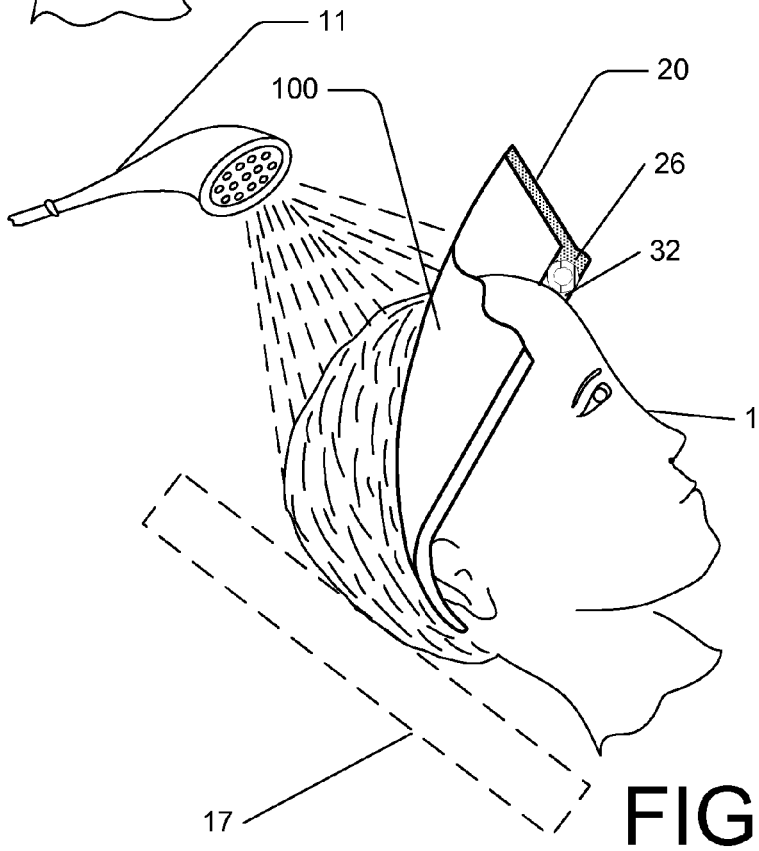
FIG. 2 is a perspective view of another exemplary head-worn liquid shield worn by a user leaning backward on a backrest of a bathtub to have the hair washed.

The brim 20 shields the user's ears and face but does not cover the user's rear head 7. Therefore, it not only effectively prevents the water or shampoo from splashing into the user's eyes but also allows the user's head to lie against the backrest 17 of a bathtub, as shown in FIG. 2.

Figure 3:
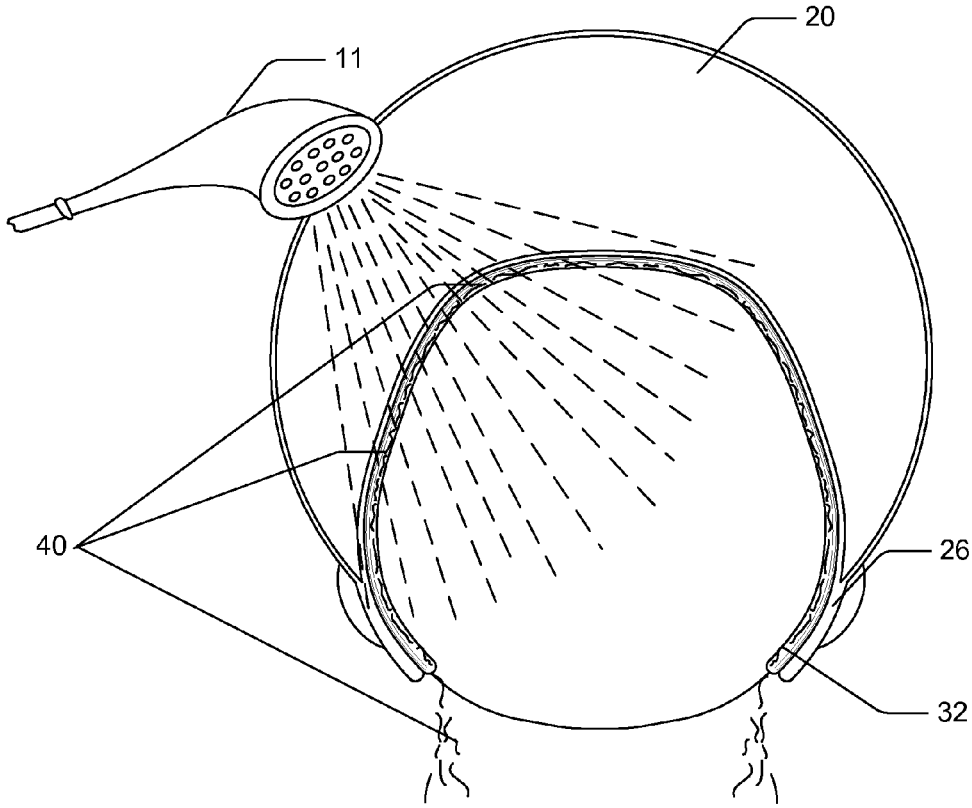
FIG. 3 is a top plan view of the liquid shield worn by a user.

The tautening edge portion 26 and the sealing tube 32, when joined to the user's head, form a channel 40 to direct water and soap and hair materials laterally and rearwardly away from a central position near the user's forehead 2 through to the bathtub or basin, as shown in FIG.3.

Figure 4:
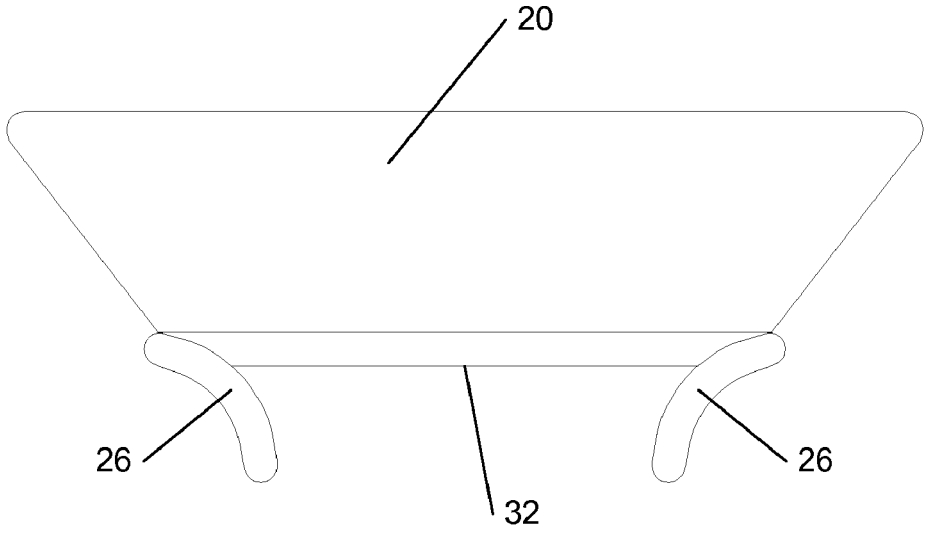
FIG. 4 is a back side view of the liquid shield.

The tautening edge portion 26 encircles a user's hair line from ear to forehead but does not encircle the user's rear head, as shown in FIG. 1 and FIG. 3. When the liquid shield is not worn by the user, the tautening edge portion 26 has two open ends, as shown in FIG. 4, defining a natural opening smaller than a lateral dimension of the user's head. The tautening edge portion 26 has sufficient flexibility to expand the two open ends to allow the tautening edge portion 26 to closely secure to the user' skin when worn.

Figure 5:
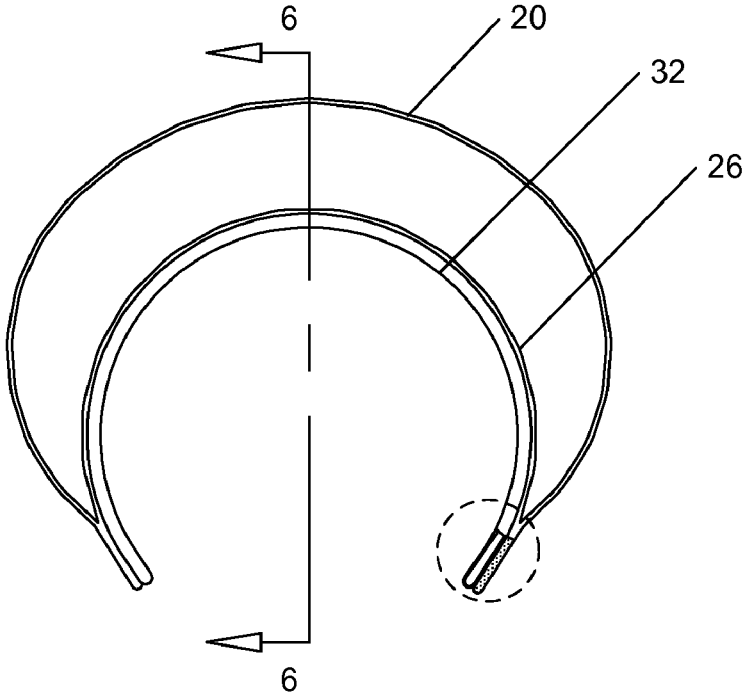
FIG. 5 is a top plan view of the liquid shield.
Figure 8:
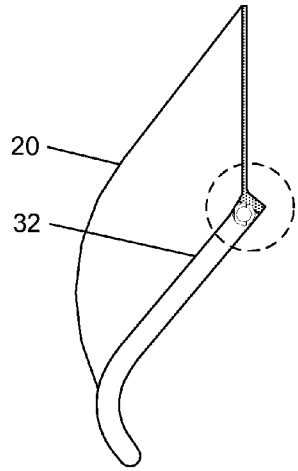
FIG. 8 is the cross-sectional view of FIG. 5, taken along line 6-6.

The brim 20 can be substantially half-circled, as shown in FIG. 5. The brim 20 tilts upward from the tautening edge portion 26, as shown in FIG. 8, and extends along the lateral side of the head from the user's forehead to the user's ears.

Figure 6:
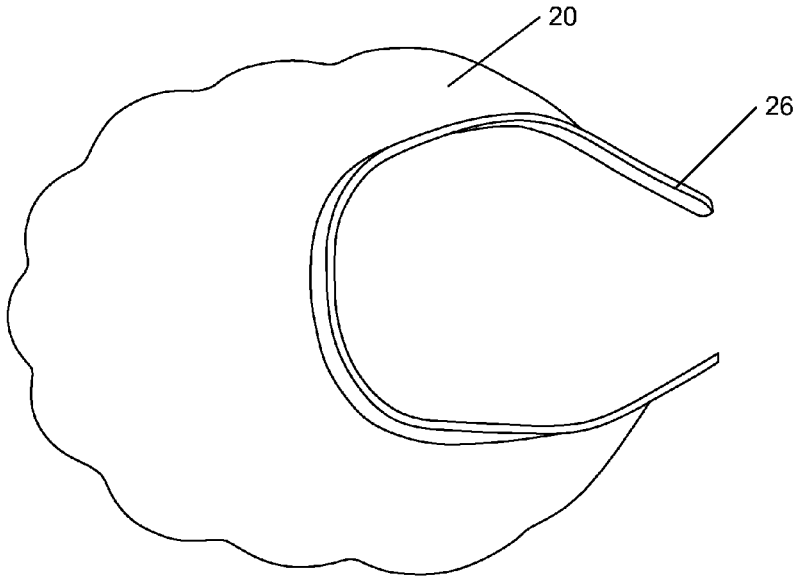
FIG. 6 is a top plan view of an alternative shape of the liquid shield.
Figure 7:
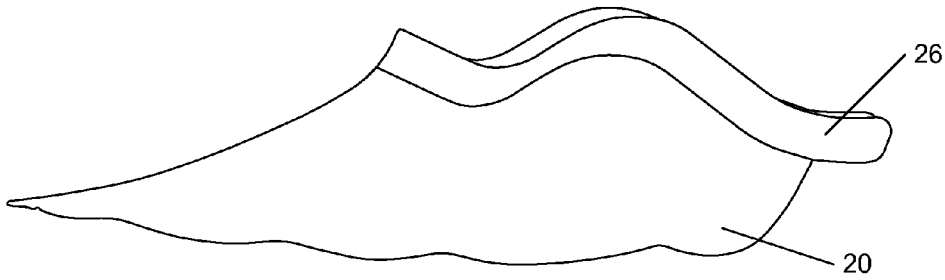
FIG. 7 is a perspective view of an alternative shape of the liquid shield.

In another implementation, the edge of the brim 20 can be in a wave shape and, especially, the wave shape matches the user's hair line along the lateral face till the ear, as shown in FIG. 6 and FIG. 7. The brim 20 can thus closely shield the user's face.

The tautening edge portion 26 can be an integral part of the brim 20 or a separate component attached to the brim 20. Both the brim 20 and the tautening edge portion 26 can be made of thin, water-proof, and elastic materials.

The sealing tube 32 is at the inner of and closely attached to the tautening edge portion 26, as shown in FIG. 3, FIG.4, and FIG. 5. The sealing tube 32 touches the user's skin, when worn, to provide a seal along the hair line of the user to direct water and soap and hair materials laterally and rearwardly away from the central portion and not downwardly drip towards the eyes, nose and ears of the user. The sealing tube 32 may be attached to the tautening edge portion 26 by heat, glue, or any other effective connection means. The cross section between the sealing tube 32 and the tautening edge portion 26 can be any shape that can effectively connected the sealing 32 and the tautening edge portion 26, such as circle, eclipse, D-shape, or wave shape.

Figure 9:
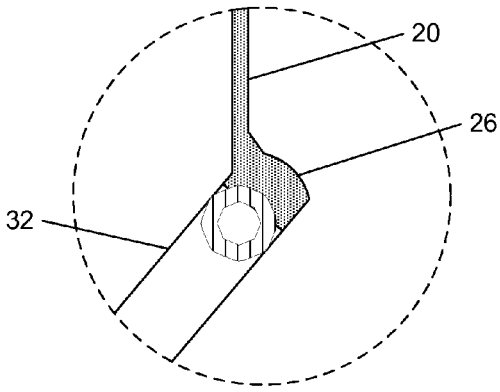
FIG. 9 is an enlarged view of the connection section of the tautening edge portion and sealing tube of the liquid shield, taken from FIG. 8.

One preferred shape of the cross section between the sealing tube 32 and the tautening edge portion 26 is circle, as shown in FIG. 9, that the tautening edge portion 26 encircles the sealing tube 32.

Figure 10:
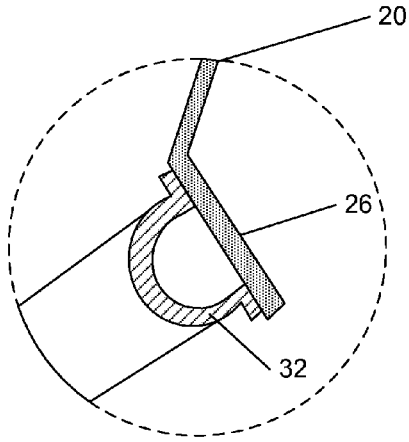
FIG. 10 is an enlarged view of an alternative connection section of the tautening edge portion and sealing tube of the liquid shield.

Another preferred shape is D-shape, as shown in FIG. 10, that one wall of the sealing tube 32 is the tautening edge portion 26.

The sealing tube 32 is made of water-proof materials and compatible with the tautening edge portion 26 in size, length and elasticity. For example, the sealing tube 32 has a length substantially matching the entire tautening edge portion from ear to ear via the user's forehead as shown in FIG. 3 and FIG. 5. As will be further described below, the sealing tube 32 is compressible to result in a diameter size automatically adjusted according to the pressure exerted on the sealing tube by the user's head.

The sealing tube 32 is a specific feature of this disclosure. Without the sealing tube 32, the tautening edge portion 26 can only apply pressure along the side face of the user. The user's forehead, despite being a portion which probably requires an even higher standard of sealing than the other portions, receives least pressure from the tautening edge portion 26. Therefore, the tautening edge portion 26 alone cannot provide an effective sealing to prevent water or shampoo from splashing into the user's face. The sealing tube 32 provides the needed sealing.

Figures 2, 12:
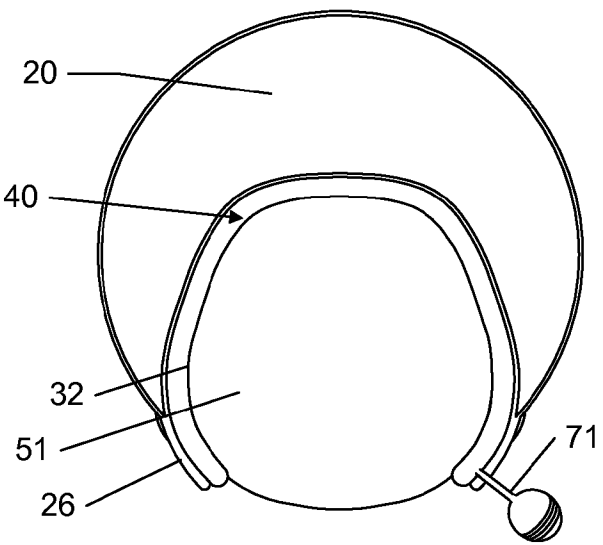
Figures 1, 12:
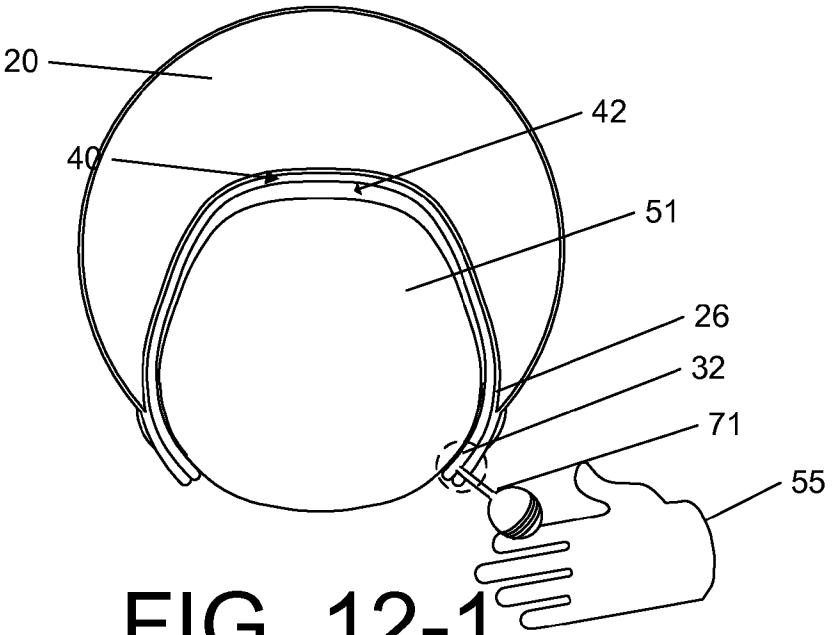

The sealing tube 32 is hollow and can distribute the proper pressure along the user's hair line from the forehead to ear to constitute an effective sealing means. The automatically adjusted diameter size of the sealing tube substantially evens the pressure along the sealing tube. The sealing tube 32 is compressible. An area on the sealing tube 32 which receives a relatively high pressure is compressed to have a reduced diameter size of the sealing tube 32, while an area which receives less pressure is expanded as a result of the compression of other areas to have an enlarged diameter size. The enlarged diameter size in turn achieves better contact with the user's head and thus improves the sealing of the respective area. This effectively distributes the pressure from high pressure points to low pressure points along the sealing tube 32 and finally makes the pressure along the sealing tube 32 even to improve sealing. When the sealing tube 32 is properly made with a suitable compressible material, such pressure transfer may occur automatically. However, as described below, manual inflation means 39, as shown in FIG. 12, may also be used to further sealing.

Figures 2, 11:
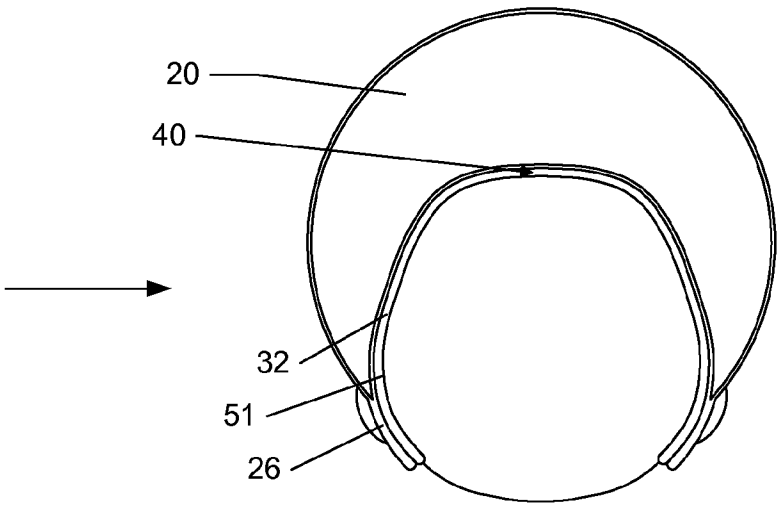
Figures 1, 11:
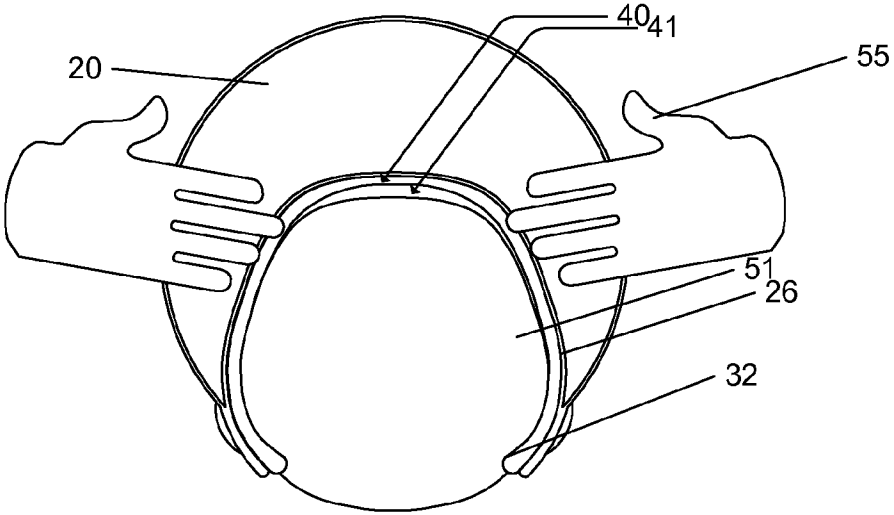

In one implementation of the sealing tube 32, the wall of the sealing tube 32 is made of expandable materials, such as non-toxic latex rubber, and can be either fully or partially filled with filler material 40. The filler material 40 can be either liquid such as water, gas such as air, or small solid pieces such as small plastic balls. Different users may have different head sizes and shapes so that the tautening edge portion 26 cannot exactly match all users' heads. As the sealing tube 32 can be extended to adjust the user's head, it solves the size problem. The precision requirement of the size of the sealing tube 32 made of expandable materials is not as rigid as that of the sealing tube made of non-extendable materials as described below. As shown in FIG. 11-1, where there is a small gap 41 between the sealing tube 32 and the user's skin 51, the gap can be eliminated by simply pressing the sealing tube 32 using hand 55. The sealing tube 32 adjusts its diameter size and distributes the proper pressure finally even along the user's hair line from the forehead to ear to constitute an effective sealing means as shown in FIG. 11-2. As shown in FIG. 12-1, when there is a wide gap 42 between the sealing tube 32 and the user's skin 51, the gap can be eliminated by increasing the pressure applied on the sealing tube 32 by pressing pump 71 using hand 55, one alternative of the inflation means 39 as described below. The diameter size of the sealing tube 32 is thus expanded to closely secure the user's skin 51, as shown in FIG. 12-2. Therefore, the sealing tube 32 can closely secure the user's hair line under the same pressure alongside the tube and the leaking problem is solved.

In another implementation of the sealing tube 32, the wall of the sealing tube 32 is made of substantially non-expandable materials that still has sufficient flexibility, such as nylon, and is partially filled with filler material 40. It thus requires that the size of the sealing tube 32 and tautening edge portion 26 closely match the user's head. Since the sealing tube 32 is partially filled, it leaves space for adjusting pressure and shape of the sealing tube 32. As shown in FIG. 11-1, where there is a small gap 41 between certain portion of the sealing tube 32 and the user's skin 51, such portion of the sealing tube can be pressed and filler material inside the sealing tube 32 can be squeezed to the space position. The filler material 40 can be either liquid such as water, gas such as air, or small solid pieces such as small plastic balls.

Figure 13:
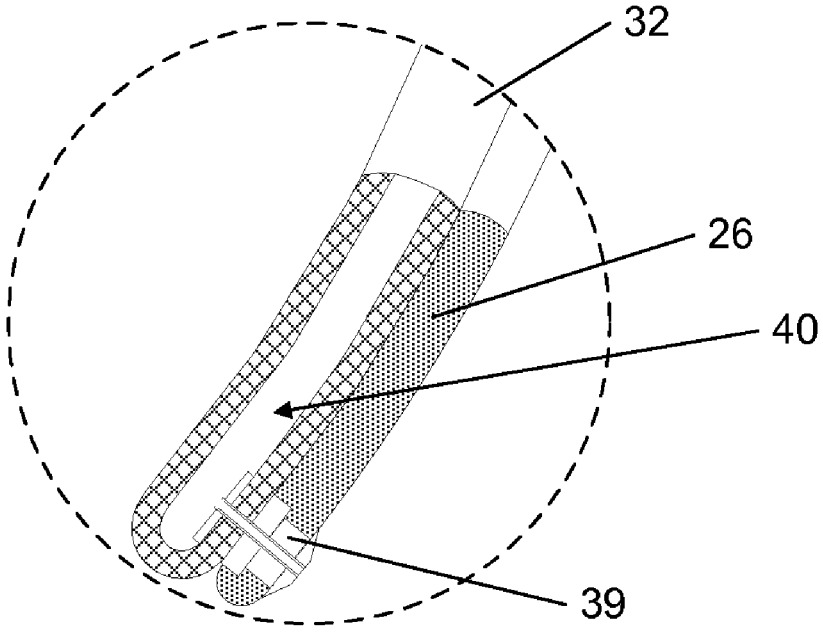
FIG. 13 is an enlarged view of one end of the sealing tube and tautening edge portion, taken from FIG. 5, and shows an additional inflation means.

In addition, the liquid shield can also include an inflation means 39 connected to the sealing tube 32 as shown in FIG. 13. The inflation means is to inflate air into the sealing tube 32 to adjust the pressure applied on the sealing tube 32 and thus adjust the diameter size of the sealing tube 32 to provide an effective sealing means encircling the user's hair line. The inflation means 39 can be located at one end of the sealing tube 32 as shown in FIG. 13, or any other places along the sealing tube 32.

The inflation means 39 can be a pump 71 including a small ball 72 and a nozzle 73, as shown in FIG. 14-1, FIG. 14-2, and FIG. 14-3. As shown in FIG. 12-1 and FIG. 12-2, it is convenient to adjust the pressure applied on the sealing tube 32 by using pump 71 so that air can be pumped into the sealing tube 32 and the diameters of the sealing tube 32 can be expanded and the size of the sealing tube 32 can be adjusted.

Figures 1, 2, 3, 14:
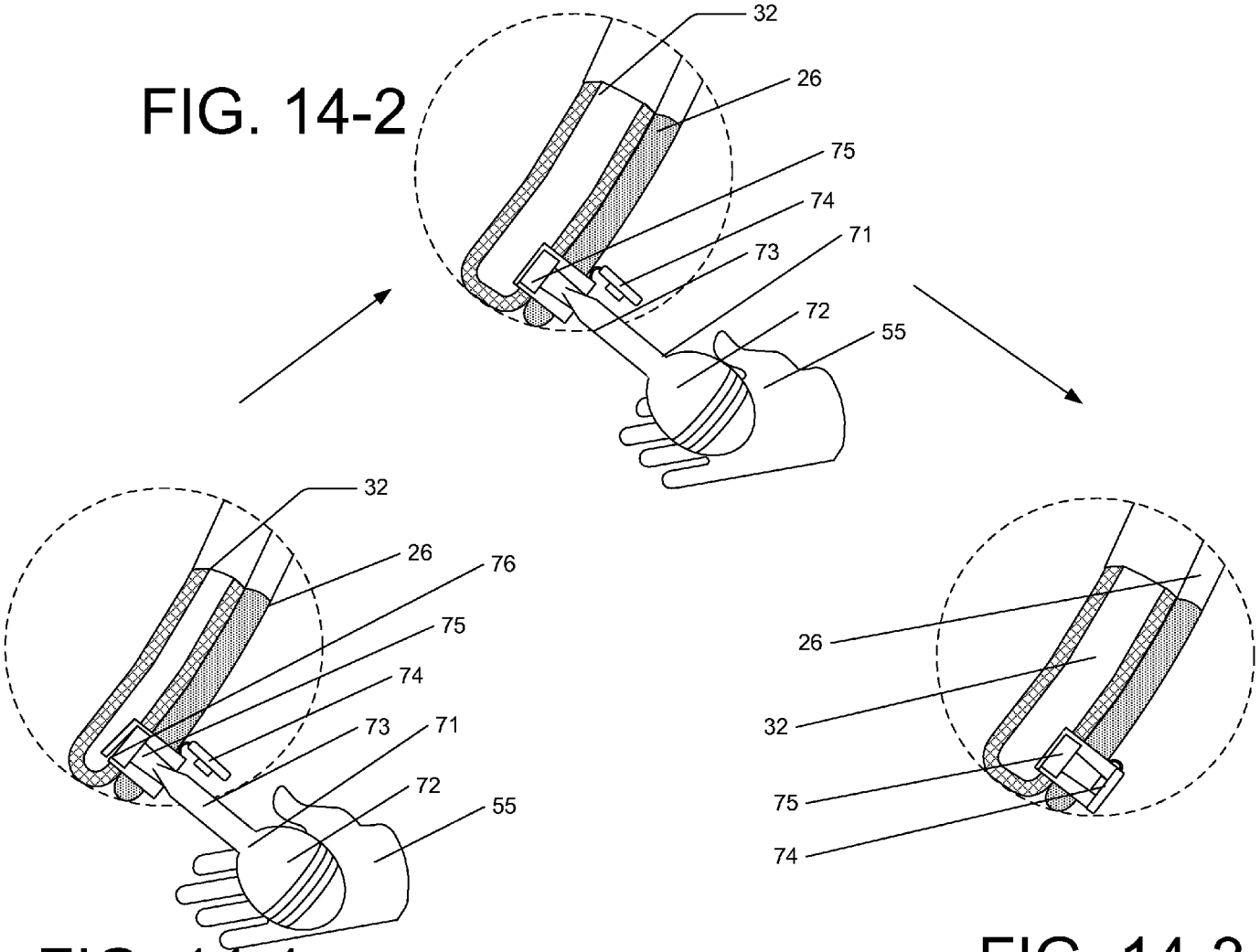

The pump 71 can be separate from the liquid shield. As shown in FIG. 14-1, when there is a need to pump air into the sealing tube 32, a cap 74 is opened and the pump 71 was pushed into an air valve 75 by the hand 55. The air valve 75 has an opening smaller than the nozzle 73 of the pump 71 so that there would be no air leakage when the pump 71 is pumping air. When the air is pumped through the air valve 75 by pump 71, the bottom of the air valve 75 will be pushed open by the air to form the air vent 76, as shown in FIG. 14-1. When enough air is pumped into the sealing tube 32, the diameter of the sealing tube 32 will be expanded and pressure inside the sealing tube 32 will be increased. Once the pumping is stopped, the air pressure inside the sealing tube 32 will push the bottom of the air valve 75 to close the air vent 76, as shown in FIG. 14-2. The pump is then removed and the cap is closed, as shown in FIG. 14-3.

Figures 2, 15:
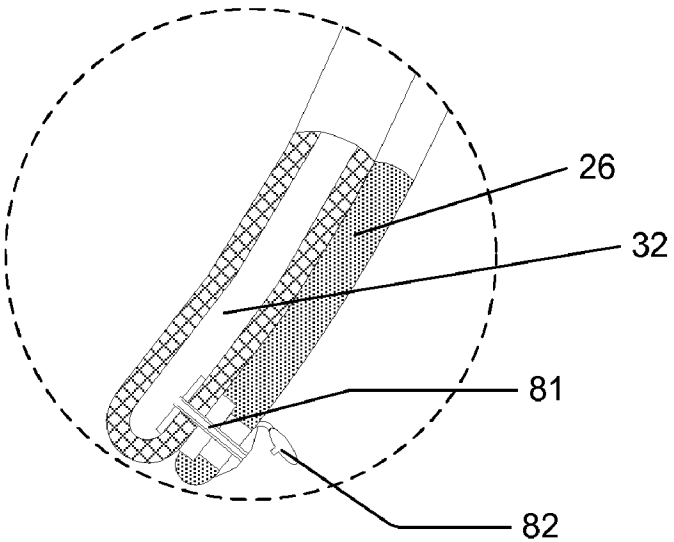
Figures 1, 15:
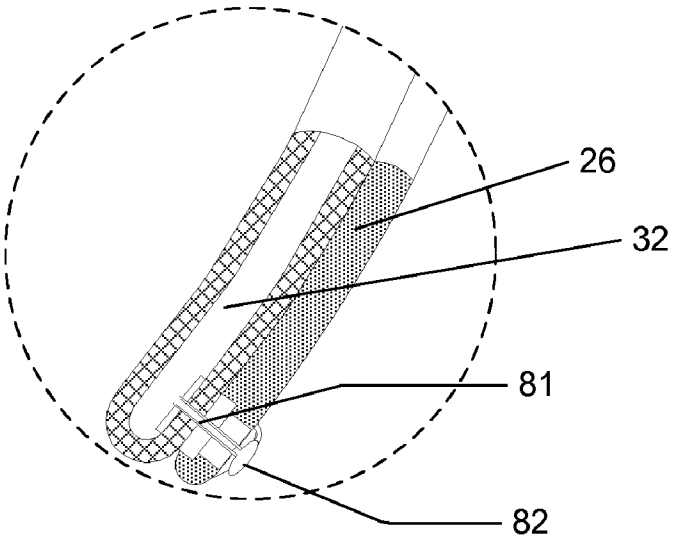

The inflation means 39 can also be a pipe 81, as shown in FIG. 15-1, one end of which is open and connects to the sealing tube, and the other end of which is exposed in the air and closed by a cap 82. As shown in FIG. 15-2, a person who washes the user's head can open the cap 82 and blow out air into the sealing tube 32 by mouth and then closes the cap 82 when the pressure applied on the sealing tube 32 is sufficient to allow the sealing tube 32 to closely secure to the user's skin.

It is contemplated that the liquid shield, including the brim 20, tautening edge portion 26, and sealing tube 32, can be formed in one or more different sizes to accommodate the heads of users. When the user is a baby, the advantageous sizes of the liquid shield are as following: the thickness of the wall of the sealing tube 32 is between 0.6 mm and 4.5 mm, the external diameter of the sealing tube 32, when not inflated, is between 10 mm and 20 mm, and the thickness of the tautening edge portion 26 is between 1 mm and 5 mm.

It is appreciated that the potential benefits and advantages discussed herein are not to be construed as a limitation or restriction to the scope of the appended claims. Although the subject matter has been described in language specific to structural features, it is to be understood that the subject matter defined in the appended claims is not necessarily limited to the specific features or drawings described. Rather, the specific features or drawings are disclosed as examples of implementing the claims.

What is claimed is:

1. A head-worn liquid shield for protecting a face of a user from washing and hairdressing materials, the head-worn liquid shield comprising:

a tautening edge portion encircling a hair line of the user from ear to ear via a forehead of the user;

a brim extending from the tautening edge portion; and a sealing tube attached to the tautening edge portion to provide a seal along the hair line of the user to prevent liquids from running through, the sealing tube being compressible and hollow, the tautening edge portion, when not worn, having two open ends defining a natural opening smaller than a lateral dimension of a head of the user, and having sufficient flexibility to expand the two open ends to allow the tautening edge portion and the sealing tube to closely secure to skin of the user when worn, the head-worn liquid shield not encircling a rear head of the user.

2. The head-worn liquid shield as recited in claim 1, wherein the tautening edge portion and the sealing tube, when joined to a head of the user, form a channel to direct water and soap and hair materials laterally and rearwardly away from a central position near the forehead of the user.

3. The head-worn liquid shield as recited in claim 1, wherein the brim is substantially half-circled.

4. The head-worn liquid shield as recited in claim 1, wherein an edge of the brim has a wave shape that matches the hair line of the user along the lateral face till the ears.

5. The head-worn liquid shield as recited in claim 1, wherein the tautening edge portion is an integral part of the brim.

6. The head-worn liquid shield as recited in claim 1, wherein the tautening edge portion is a separate part attached to the brim.

7. The head-worn liquid shield as recited in claim 1, wherein the tautening edge portion is elastic.

8. The head-worn liquid shield as recited in claim 1, wherein the tautening edge portion and sealing tube are joined together by heat or glue.

9. The head-worn liquid shield as recited in claim 1, wherein the cross section between the tautening edge portion and the sealing tube is circular.

10. The head-worn liquid shield as recited in claim 1, wherein the cross section between the tautening edge portion and the sealing tube has a D-shape that the tautening edge portion constitutes one wall of the sealing tube.

11. The head-worn liquid shield as recited in claim 1, wherein the sealing tube has a length substantially matching the entire tautening edge portion.

12. The head-worn liquid shield as recited in claim 1, wherein the sealing tube is water proof.

13. The head-worn liquid shield as recited in claim 1, wherein the sealing tube is compatible with the tautening edge portion in elasticity.

14. The head-worn liquid shield as recited in claim 1, wherein the sealing tube has a wall made of an expandable material.

15. The head-worn liquid shield as recited in claim 1, wherein the automatically adjusted diameter size of the sealing tube substantially evens the pressure along the sealing tube.

16. The head-worn liquid shield as recited in claim 1, wherein the sealing tube has a wall made of a material which is substantially non-expandable but still has sufficient flexibility to allow the sealing tube to be compressible.

17. The head-worn liquid shield as recited in claim 1, wherein the sealing tube is at least partially filled with a filler material.

18. The head-worn liquid shield as recited in claim 17, wherein the filler material is a liquid.

19. The head-worn liquid shield as recited in claim 17, wherein the filler material is a gas.

20. The head-worn liquid shield as recited in claim 17, wherein the filler material comprises small solid pieces.

21. The head-worn liquid shield as recited in claim 17, wherein the filler material inside the sealing tube is movable to a spaced position between the skin of the user and the sealing tube to expand a diameter size of the sealing tube to secure to the skin of the user.

22. The head-worn liquid shield as recited in claim 1, further comprising an inflation means connected to the sealing tube to adjust the diameter size of the sealing tube.

23. The head-worn liquid shield as recited in claim 22, wherein the inflation means comprises a pump including a nozzle and a small ball pushable by a person to pump air into the sealing tube.

24. The head-worn liquid shield as recited in claim 23, wherein the pump is separable from the liquid shield.

25. The head-worn liquid shield as recited in claim 1, wherein the liquid shield is suited for a baby, a wall of the sealing tube has a thickness between 0.6 mm and 4.5 mm, and an external diameter of the sealing tube has a thickness, when not inflated, between 10 mm and 20 mm, and the tautening edge portion has a thickness between 1 mm and 5 mm.

26. The head-worn liquid shield as recited in claim 1, wherein the brim tilts upward from the tautening edge portion.

* * * * *